United States Patent [19]

Harrison et al.

[11] Patent Number: 4,753,088

[45] Date of Patent: Jun. 28, 1988

[54] MESH KNIT FABRICS HAVING ELECTRICALLY CONDUCTIVE FILAMENTS FOR USE IN MANUFACTURE OF ANTI-STATIC GARMENTS AND ACCESSORIES

[75] Inventors: John M. Harrison, Chattanooga, Tenn.; Roger R. Varin, Greenville, S.C.

[73] Assignee: Collins & Aikman Corporation, New York, N.Y.

[21] Appl. No.: 918,770

[22] Filed: Oct. 14, 1986

[51] Int. Cl.[4] ..... D04B 7/16

[52] U.S. Cl. ..... 66/202; 2/48; 2/93; 2/125; 2/46; 66/190; 66/192

[58] Field of Search ..... 66/202, 192, 190, 193, 66/195; 139/425 R, 425 A; 420/242; 57/901; 361/220, 212; 174/117 M

[56] References Cited

U.S. PATENT DOCUMENTS

| | | |
|---|---|---|
| 2,845,962 | 8/1958 | Bulgin . |
| 3,011,172 | 12/1961 | Tames . |
| 3,288,175 | 11/1966 | Valko . |
| 3,422,460 | 1/1969 | Burke et al. . |
| 3,582,448 | 6/1971 | Okuhashi et al. . |
| 3,586,597 | 6/1971 | Okuhashi et al. . |
| 3,699,590 | 10/1972 | Webber et al. . |
| 3,764,097 | 10/1973 | Matthews, Jr. et al. . |
| 3,806,959 | 4/1974 | Gross . |
| 3,986,530 | 10/1976 | Mackawa . |
| 4,232,082 | 11/1980 | Noritake . |
| 4,335,589 | 6/1982 | Flasher . |
| 4,398,277 | 8/1983 | Christiansen et al. . |
| 4,422,483 | 12/1983 | Zins . |
| 4,475,141 | 10/1984 | Antonevich . |
| 4,557,968 | 12/1985 | Thornton et al. . |
| 4,590,623 | 5/1986 | Kitchman . |
| 4,606,968 | 8/1986 | Thornton et al. . |

FOREIGN PATENT DOCUMENTS

| | | | |
|---|---|---|---|
| 471406 | 8/1976 | U.S.S.R. | 66/192 |

*Primary Examiner*—Ronald Feldbaum

*Attorney, Agent, or Firm*—Bell, Seltzer, Park & Gibson

[57] ABSTRACT

The open mesh warp knit fabric of the present invention includes a base fabric knit with electrically nonconductive base yarn and forming an open mesh pattern of lightweight construction having spaced openings to provide ventilation therethrough. Electrically conductive filaments are incorporated in the base fabric and provide an open grid extending throughout the entire area of the base fabrics with the conductive filaments being incorporated predominantly in only one side of the base fabric. The conductive yarns provide only about one-half of one percent of the total weight of the fabric and are of a relatively fine denier so that the conductive yarn is substantially invisible to the naked eye. Various types of garments and accessories are illustrated as being formed of the electrostatic dissipating fabric.

17 Claims, 3 Drawing Sheets

MESH KNIT FABRICS HAVING ELECTRICALLY CONDUCTIVE FILAMENTS FOR USE IN MANUFACTURE OF ANTI-STATIC GARMENTS AND ACCESSORIES

FIELD OF THE INVENTION

This invention relates generally to a mesh knit fabric including electrically conductive filaments incorporated therein for use in the manufacture of anti-static garments and the like, and more particularly to such a fabric which is of lightweight open construction and includes a very small amount of electrically conductive yarn which is positioned predominantly on one side of the fabric and forms an electrically conductive grid that is substantially invisible to the naked eye.

BACKGROUND OF THE INVENTION

It is well known that normal clothing fabric has a tendency to become charged with static electricity which causes the clothing to cling to the wearer's body and often results in the arcing or sparking of the static electricity when the fabric is positioned in close proximity to a source of ground. The sparking or arcing of the static electricity is an annoyance to persons wearing the clothing in ordinary environments and can be extremely dangerous in certain occupations. For example, in clean room environments where electronic equipment is being manufactured and/or assembled the build-up of static electricity in the clothing can cause damage to the electronic equipment being manufactured and/or assembled.

Recognizing the inherent problem in the build-up of static electricity in clothing, many different types of anti-static fabric have been proposed in which various types of electrically conductive yarns and fibers have been incorporated to provide a controlled dissipation of static electricity into the atmosphere and to a ground.

The Webber et al U.S. Pat. No. 3,699,590 discloses a woman's slip in which an electrically conductive yarn formed of staple metal fibers may be uniformly distributed throughout the entire fabric or may be incorporated in the stitching and trim of the slip so that the static electricity is dissipated by the metallic fibers or yarns. The electrically conductive yarn is disclosed as being incorporated in woven fabric and warp and weft knit fabrics of various types with relatively low percentages of the metal fibers being incorporated in the fabric, on the order of approximately one-half to five percent. The anti-static garments disclosed in this patent are of the conventional clothing type, such as undergarments, socks and hose, sweaters, skirts, dresses, blouses, men's shorts, shirts, etc. While the garments of this patent may be suitable for conventional clothing wear to prevent a sufficient amount of static build-up to prevent the clinging of the clothing to the wearer, the garments of this patent are not satisfactory for use by workers in environments where the sparking or arcing of static electricity can cause damage to the products being worked upon.

The Thornton et al U.S. Pat. No. 4,557,968 discloses an electrostatic dissipating fabric which is illustrated as being woven, but which is described as also being knit, with a grid being formed in the fabric of electrically conductive yarns to dissipate the static electricity. The electrically conductive yarn is incorporated in the fabric in such a manner that the electrically conductive yarns form a raised grid of parallel yarns extending from one face of the fabric and extending from the front to the back surfaces of the fabric. The raised parallel grid of electrically conductive yarns extending from one face of the fabric of this patent may become snagged and pull, not only producing an unsightly appearance but may become broken and interfere with the conductive grid provided by the electrically conductive yarns incorporated in the fabric.

The above-identified patents are merely representative of the many prior art patents relating generally to the production of anti-static fabric with the incorporation therein of some type of electrically conductive yarns. Many of these prior art types of anti-static fabric have been utilized in the formation of various types of clothing and accessories for use by workers in environments where it is important to control and dissipate static electricity into the atmosphere or through a suitable grounding wire. Various types of clothing articles and accessories, such as sleeves, stool covers and the like are currently being offered for sale. Generally, anti-static clothing and accessories currently being offered can be characterized as being formed of a relatively heavy fabric, within the range of five to seven ounces per square yard, and are hot and uncomfortable for wear over the normal clothing of the worker. Also, anti-static garments of the prior art are usually woven or knit of a close construction and do not permit the free passage of air therethrough so that the usual clothing worn by the worker is not visible through the fabric forming the anti-static garment.

SUMMARY OF THE INVENTION

With the foregoing in mind, it is an object of the present invention to provide an open mesh knit fabric including electrically conductive filaments incorporated therein for use in manufacturing anti-static garments and accessories of lightweight construction and high porosity, and with the electrically conductive yarns being incorporated in the fabric to be positioned predominantly on one side of the fabric, being of a very small percentage of the total weight of the fabric, and being of such small size that the electrically conductive yarns are substantially invisible to the naked eye.

The open mesh anti-static fabric of the present invention is primarily for use in the manufacture of anti-static garments and accessories and the garments and the like produced therefrom are very lightweight, preferably from two to three ounces per square yard, so that the garment is very lightweight, permits ready passage of air therethrough, and forms a type of a net covering the wearer to permit substantially full view of the clothing therebeneath. A very small amount of the electrically conductive yarn is incorporated in the knit fabric, preferably on the order of 0.25 to 1.0 percent by weight. The size of the electrically conductive yarn is also very small, relative to the size of the base yarn forming the base knit fabric, on the order of about 21 denier, as compared to a base yarn of about 150 denier, so that the electrically conductive yarn is substantially invisible to the naked eye and is microscopically visible.

The electrically conductive yarn incorporated in the knit fabric is preferably nylon with finely divided particles of electrically conductive carbon black dispersed therein. The carbon black gives the yarn a black color and it is, therefore, desirable that the size of the electrically conductive yarn be small enough that it is substantially invisible.

In order to form the open mesh base fabric, a base yarn, preferably polyester, is knit to form interconnected stitch loop chains forming successive courses and wales and forming diamond-shaped openings in the base fabric. One set of electrically conductive filaments is inlaid in spaced-apart selected ones of the zigzag stitch loop chains and another set of the electrically conductive filaments is inlaid in a zigzag path extending back and forth between the zigzag stitch loop chains. Both sets of inlaid electrically conductive filaments are positioned primarily and predominantly on one side of the base fabric and provide a conductive grid extending throughout the open mesh fabric. The conductive grid is sufficiently exposed that it readily absorbs and dissipates any static electricity which tends to build up in the garment.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

The preferred open mesh fabric of the present invention, broadly indicated at 10, is preferably knit on a Liba four-bar warp knitting machine to form a base fabric knit with first and second sets of nonconductive base yarns 11, 12. The nonconductive base yarns 11, 12 are fed to the needles through the respective first and fourth yarn guide bars, in a manner to be described in detail below. The sets of base warp yarns 11, 12 form interconnected adjacent zigzag stitch loop chains, as shown in FIG. 2, forming diamond-shaped openings 15 to provide substantially unobstructed ventilation through the fabric.

First and second sets of electrically conductive yarns 13, 14 are incorporated in the base fabric. The conductive yarns 13, 14 are fed to the needles through the respective second and third guide bars, in a manner to be described in detail below.

Figure 2:
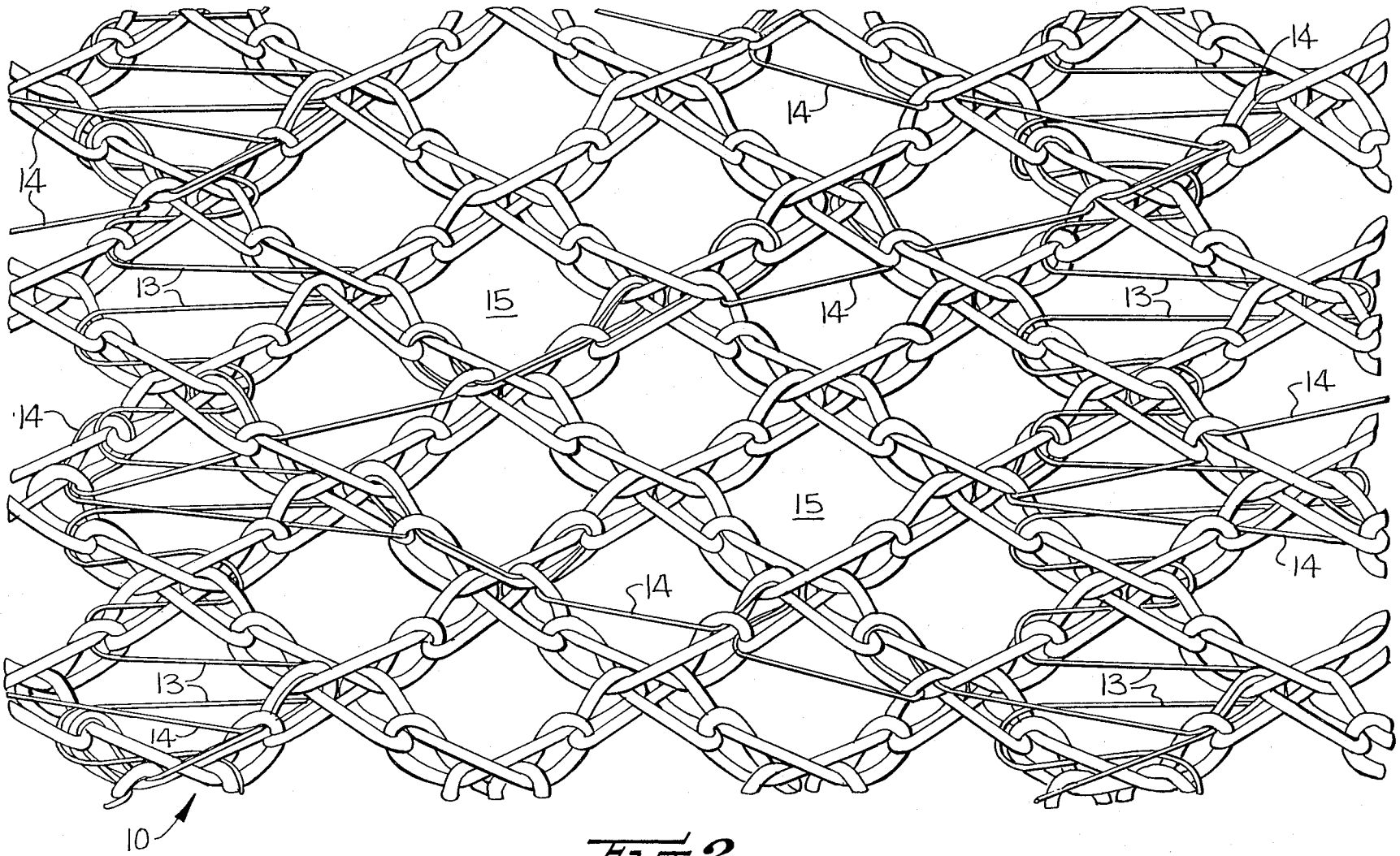
FIG. 2 is a greatly enlarged elevational view looking at the back side of the anti-static fabric of the present invention and illustrating a preferred method of incorporating the electrically conductive filaments in the base fabric.

As will be noted in FIG. 2, the set of electrically conductive yarns 13 is inlaid in and crosses between spaced-apart selected pairs of adjacent and interconnected zigzag stitch loop chains. The other set of electrically conductive filaments or yarns 14 is interknit with the base yarns 11, 12 and in a zigzag path extending back and forth between the zigzag stitch loop chains. The set of electrically conductive yarns 14 extends in one diagonal direction over seven wales and during the knitting of six courses and then extends in the other diagonal direction over seven wales and during the knitting of six courses. The electrically conductive yarns 13 thus form spaced-apart walewise extending rows in the base fabric with substantially horizontal runs of electrically conductive yarn 13 extending across spaced-apart walewise lines of the diamond-shaped openings 15. The zigzag path of the electrically conductive yarns 14 extends between and overlaps the walewise rows of the electrically conductive yarns 13 and provides segments of yarn 13 extending diagonally across the diamond-shaped openings 15. Thus, the electrically conductive yarns 13, 14 form an open grid incorporated predominantly on only one side of the base fabric and extending throughout the entire area of the base fabric. The electrically conductive filaments 13, 14 are illustrated in FIG. 2 as being incorporated in the back side of the base fabric. The fabric of FIG. 2 is illustrated as it would appear if no distortion of the stitch loops occurred. As is well known, the stitch loops do distort, particularly when the fabric is knit of textured yarns, and the inlaid conductive yarn 13 tends to draw the openings 15 together, producing vertical lines in the fabric.

The anti-static fabric is of a lightweight construction wherein the base yarns 11, 12 are polyester 150/34 denier textured and the conductive filaments 13, 14 are conductive nylon 6 monofilament of 21 denier to produce a knit fabric having a total weight of about $2\frac{1}{4}$ ounces per square yard. The base yarns 11, 12 comprise about $99\frac{1}{2}$ percent of the total weight and the conductive filaments 13, 14 comprise about one-half of one percent of the total weight. The conductive filaments 13, 14 are thus about one-seventh the size of the base yarns 11, 12 so that the conductive filaments are invisible to the naked eye but are visible by the use of a microscope or other enlargement equipment. The size of the conductive filaments 13, 14 is no more than one-fifth the size of the base yarns 11, 12.

While the base yarns 11, 12 have been described as being polyester, other types of nonconductive natural or synthetic yarns may be employed. A satisfactory anti-static fabric has been knit with electrically conductive yarns 13, 14 of carbonfilled nylon of the type currently being sold by Dow Badische Company as F-901 conductive nylon 6 monofilament. However, it is to be understood that other types of electrically conductive yarns are also commercially available and can be used. Such electrically conductive yarns are disclosed in U.S. Pat. Nos. 4,045,949 and 4,064,075.

Figure 1:
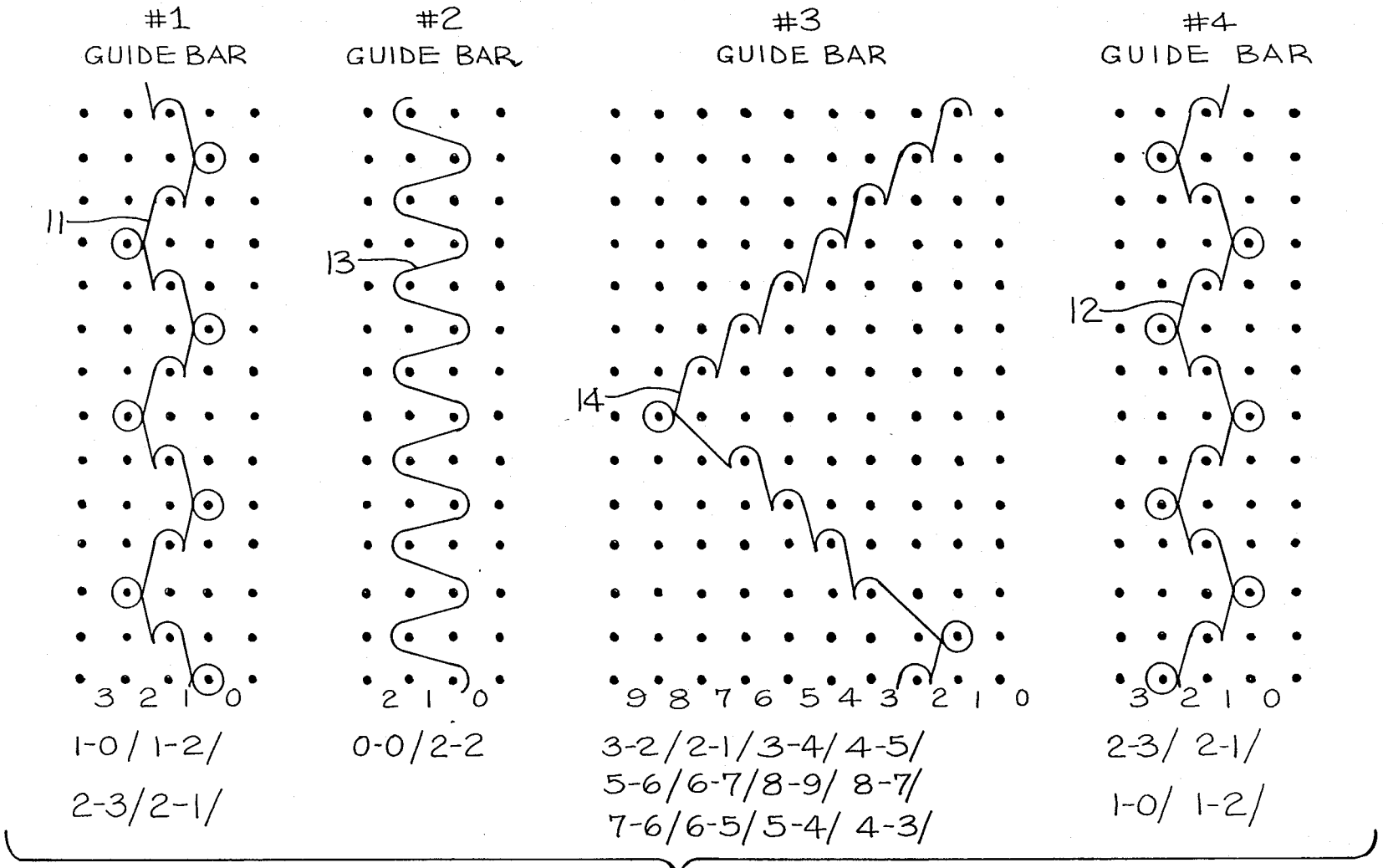
FIG. 1 is a point diagram illustrating the yarn guide bar notations utilized in knitting the anti-static fabric of the present invention.

As illustrated in FIG. 1, the open mesh warp knit fabric according to the present invention is a fourbar warp knit fabric with one set of base yarns 11 being fed by a first guide bar having a movement of 1-0/1-2/2-3/2-1, and the other set of base yarns 12 being fed by the fourth guide bar having a movement of 2-3/2-1/1-0/1-2. One set of electrically conductive filaments 13 is fed by the second guide bar having a movement of 0-0/2-2, and the other set of electrically conductive filaments 14 being fed by the third guide bar having a movement of 3-2/2-1/3-4/4-5/5-6/6-7/8-9/8-7/7-6/6-5/5-4/4-3.

The open mesh warp knit anti-static fabric of the present invention is of a sufficiently lightweight construction that it is not heavy when formed into a garment and the open diamond-shaped openings provide sufficient ventilation that the garment is not hot. The diamond-shaped openings also provide a "see-through" feature so that the conventional garments of the worker can be observed through the anti-static fabric. The electrically conductive fibers 13, 14 form an open grid having integrity and extending throughout the entire area of the base fabric. The open grid is positioned predominantly on only one side of the base fabric and acts to rapidly dissipate any static electricity which tends to build up in the fabric.

Figure 3:
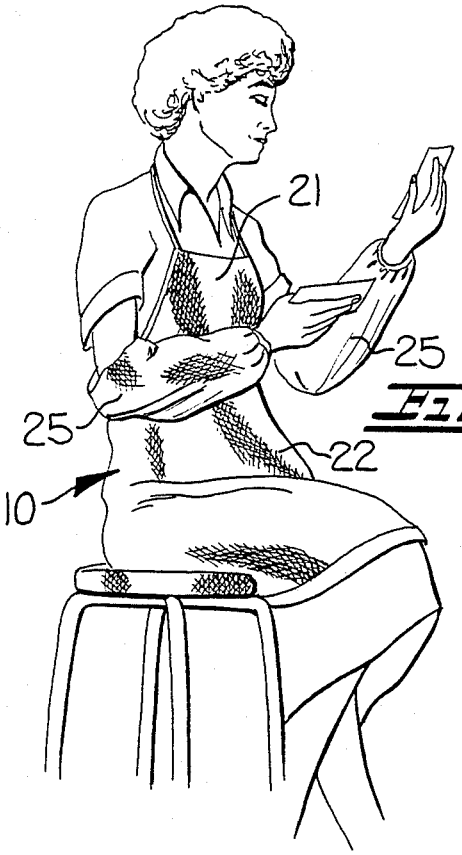
FIG. 3 is a perspective view of a lady wearing an apron and sleeves formed of the present fabric.

FIG. 3 illustrates an apron-type of anti-static garment formed of the open mesh knit fabric 10 and including an upper bib portion 21 and a lower wrap around skirt-like front portion 22. As illustrated, the interconnected stitch loop chains extend generally vertically throughout the bib portion 21 and the skirt-like front lower portion 22. Suitable binding or hem material 23 can be attached around the outer peripheral edge of the apron and the usual neck strap 24 and tie straps, not shown, are provided to secure the apron in position on the wearer. FIG. 3 also illustrates a pair of sleeve protectors 25 positioned on the lower arm portions of the wearer. The sleeve protectors 25 each includes an elongated tubular body which is formed of the open mesh fabric 10 and may be provided with longitudinal seams. Opposite end portions of the sleeves 25 are provided with suitable elastic material surrounding opposite ends thereof and the interconnected stitch loop chains extend generally vertically or longitudinally from one end to the other of the sleeve protectors 25.

Figure 4:
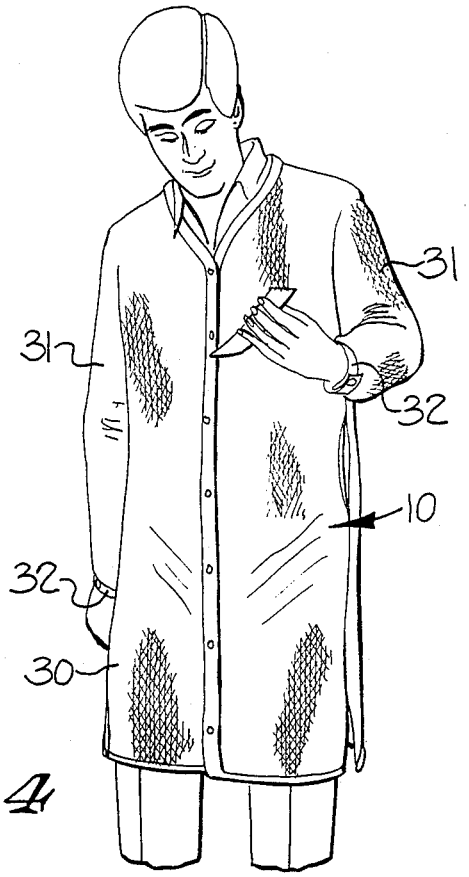
FIG. 4 is a perspective view of a man wearing a lab coat formed of the anti-static fabric of the present invention.
Figure 5:
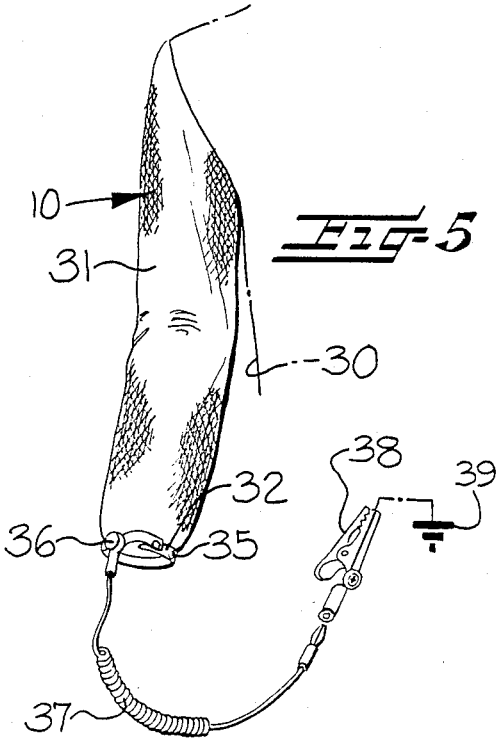
FIG. 5 is a perspective isometric view of the lower portion of one of the sleeves of the lab coat illustrated in FIG. 4 and showing the manner in which snap connectors are provided for attachment to a ground wire.

FIG. 4 illustrates a lab coat formed of the open mesh knit fabric 10. The lab coat includes a body portion 30 adapted to cover the upper body of the wearer and extending downwardly to a position substantially around the knees of the wearer. Sleeves 31 are suitably connected at their upper ends to the body portion 30 and cuffs 32 surround the lower ends of the sleeves 31. The interconnected stitch loop chains preferably extend from the top to the bottom of the body portion 30 and from the top to the cuffs 32 of the sleeves 31, as illustrated in FIG. 4. A suitable binding material or tape 33 can be applied to the peripheral edge portion of the lab coat 30 and to the lower cuff portions 32 of the sleeves 31. Spaced-apart male and female snap connectors 35 are fixed on the cuff portions 32 and may be connected together to provide a snug fit around the wrist of the wearer. All of the snap connectors 35 make electrical contact with the electrically conductive yarns 13, 14 in the fabric 10 and may be used to physically ground the lab coat 30. To this end, a snap connector 36 is fixed on one end of a ground wire 37 and is adapted to be connected to one of the snap connectors 35 on the cuff 32. An alligator type connector 38 is provided at the opposite end of the ground wire 37 and is adapted to be connected to a suitable ground, schematically illustrated at 39 in FIG. 5, so that any electrostatic charge which tends to build up in the lab coat 30 can be immediately passed to ground.

Figure 6:
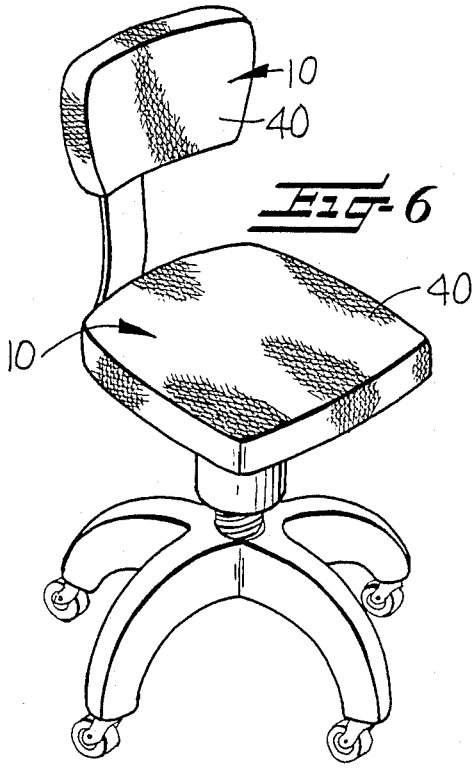
FIG. 6 is a perspective view of a typical chair in which the seat and backrest are provided with covers formed of the present anti-static fabric.

The stool cover 40, illustrated in FIG. 6, includes a circular piece of the knit fabric 10 with an edge strip stitched around the outer edge thereof. Suitable elastic material, not shown, is provided around the outer periphery thereof for maintaining the stool cover in a stretched position on the seat of the chair, and, if desired, on the backrest portion of the chair. As will be noted in FIG. 6, the interconnected zigzag stitch loop chains extend across both the backrest and the seat of the chair in FIG. 6.

In producing the garments and accessories shown in FIGS. 3–6, the open mesh knit fabric 10 is cut and sewn together so that the electrically conductive yarns 13, 14 are positioned on the outside of the garments and accessories, as shown in FIG. 2. However, the grid formed by the electrically conductive yarns 13, 14 is almost fully exposed on both sides of the fabric 10 because of the open mesh construction of the fabric, and because the electrically conductive yarns 13, 14 are not buried in the nonconductive base yarns 11, 12.

While the electrostatic dissipating fabric of the present invention is primarily adapted for use in the manufacture of anti-static garments and the like, it is to be understood that the present electrostatic dissipating fabric can also be used to prevent the build-up of static electricity in various types of electronic equipment by merely wrapping or draping a quantity of the fabric over the part or parts to be protected against electrostatic build-up, as the parts are being shipped from location to another. Also, the present electrostatic dissipating fabric can be used as a shielding material to prevent static or other harmful waves or signals from interfering with or damaging highly sensitive machinery or the like, such as radio frequency waves and the like.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A warp knit fabric having electrically conductive filaments for use in the manufacture of anti-static garments and the like, said fabric including a base fabric knit with electrically nonconductive base yarn and forming an open pattern of lightweight construction having spaced openings to provide ventilation therethrough, and electrically conductive filaments laid in said base fabric and providing an open grid extending throughout the entire area of said base fabric, said conductive filament being incorporated predominantly in only one side of said base fabric.

2. A knit fabric according to claim 1 wherein the total weight of said fabric is no more than about 2¼ ounces per square yard.

3. A knit fabric according to claim 1 wherein said base yarn comprise about 99½% of the total weight, and said conductive filaments comprises about one-half of one percent of the total weight.

4. A knit fabric according to claim 1 wherein said conductive filaments are no more than one-fifth the size of said base yarn.

5. A knit fabric according to claim 1 wherein said conductive filaments are about one-seventh the size of said base yarn so that said conductive filaments are substantially invisible to the naked eye.

6. A knit fabric according to claim 1 wherein said base yarn is synthetic and is about 150 denier.

7. A knit fabric according to claim 1 wherein said conductive filaments are conductive nylon 6 monofilament and is about 21 denier.

8. A knit fabric according to claim 1 wherein said base fabric is warp knit and includes successive courses and adjacent wales, and wherein said conductive yarns are laid in spaced courses and wales thereof.

9. A knit fabric according to claim 8 wherein said warp knit base fabric includes two sets of base warp yarns, and wherein two sets of conductive yarns are incorporated in said base fabric.

10. A knit fabric according to claim 9 wherein said fabric is a four-bar fabric with one of said sets of base warp yarns being fed by one guide bar having a movement of 1-0/1-2/2-3/2-1, the other set of base warp yarns is fed by another guide bar having a movement of 2-3/2-1/1-0/1-2, one of said sets of conductive filaments is fed by a guide bar having a movement of 0-0/2-2, and the other of said sets of conductive filaments is fed by another guide bar having a movement of 3-2/2-1/3-4/4-5/5-6/6-7/8-9/8-7/7-6/6-5/5-4/4-3.

11. A knit fabric according to claim 9 wherein said two sets of base warp yarns form interconnected adjacent zigzag stitch loop chains forming diamondshaped openings in said base fabric, and wherein one set of said conductive filaments is inlaid in spaced-apart selected pairs of said zigzag stitch loop chains, and the other set of said conductive filaments is interknit in a zigzag path extending back and forth between said selected pairs of said zigzag stitch loop chains.

12. A lightweight electrostatic dissipating fabric for use in the manufacture of anti-static garments and the like and including a base fabric comprising warp knit electrically non-conductive base yarn forming an open structure of interconnected stitch loop chains forming successive courses and wales, and electrically conductive yarns laid in selected courses and wales and forming an open grid extending throughout the entire area of said base fabric, said conductive yarns being less than one-fifth the size of said base yarn so that said conductive yarns are substantially macroscopically invisible when viewing the electrostatic dissipating fabric.

13. An electrostatic dissipating fabric according to claim 12 wherein said conductive yarns are positioned predominantly on one side of said base fabric.

14. An electrostatic dissipating fabric according to claim 12 wherein said base yarn comprises approximately 99½% of the total weight of the electrostatic dissipating fabric, and said conductive yarns comprise approximately one-half of one percent of the total weight of the electrostatic dissipating fabric.

15. An anti-static garment formed of the electrostatic dissipating fabric of claim 12 wherein said garment comprises an apron with an upper bib portion and a lower skirt-like front portion, and wherein said interconnected stitch loop chains extend generally vertically throughout said bib portion and said skirt-like front portion.

16. An anti-static garment formed of the electrostatic dissipating fabric of claim 12 wherein said garment comprises a pair of sleeve protectors each comprising an elongated tubular body with elastic surrounding opposite ends thereof, and wherein said interconnected stitch loop chains extend from one end to the other.

17. An anti-static garment formed of the electrostatic dissipating fabric of claim 12 wherein said garment comprises a lab coat including a body portion adapted to cover the upper body of the wearer, sleeves adapted to cover the arms of the wearer, and cuffs surrounding the lower ends of said sleeves, and wherein said interconnected stitch loop chains extend from the top to the bottom of said body portion and from the top of the sleeves to the cuffs of said sleeves.

* * * * *